United States Patent [19]

Smith

[11] 4,094,023

[45] June 13, 1978

[54] VENTILATED TOILET SEAT

[76] Inventor: Donald L. Smith, P.O. Box 206, Salem, Ill. 62881

[21] Appl. No.: 639,772

[22] Filed: Dec. 11, 1975

[51] Int. Cl.[2] ..... E03D 9/04; A47K 13/00

[52] U.S. Cl. ..... 4/213; 4/217; 285/9 R; 285/9 M

[58] Field of Search ..... 4/209, 213, 217; 285/9 R, 9 M

[56] References Cited

U.S. PATENT DOCUMENTS

| | | | |
|---|---|---|---|
| 962,490 | 6/1910 | Bruder | 4/217 |
| 1,972,076 | 9/1934 | Cross | 4/217 |
| 2,062,806 | 12/1936 | Casler | 285/9 R |
| 2,146,982 | 2/1939 | Perreault | 4/217 |
| 2,309,885 | 2/1943 | Carman | 4/213 |
| 2,575,778 | 11/1951 | Wilson | 4/213 |
| 2,985,890 | 5/1961 | Baither | 4/213 |
| 3,181,895 | 5/1965 | Cator | 285/9 M |
| 3,339,845 | 9/1967 | Bond | 285/9 R |
| 3,534,415 | 10/1970 | Huffman | 4/213 |
| 3,659,296 | 5/1972 | Stamper | 4/217 |

*Primary Examiner*—Henry K. Artis

*Attorney, Agent, or Firm*—Edward F. Connors

[57] ABSTRACT

A toilet seat is provided on its underside with a suction tube having perforations that are in communication with the interior of the toilet bowl when the seat rests on the upper edge of the bowl with a sealing gasket arranged on the underside of the seat outwardly of such tube. When the seat rests on the upper edge of the bowl the suction tube is communicated with an electrically motorized suction blower unit through a mating face joint. An adjustable discharge tube extends from the blower unit into the bowl and is designed to extend under the trap and is adapted to be sealed off by the water normally present in the bowl so as to prevent sewer gases from coming into the bowl while causing odors from the bowl to be discharged through the normal drain passage of the bowl into the sewer line when the seat is down and the suction blower unit is activated by household electrical current through a switch unit.

7 Claims, 8 Drawing Figures

FIG. 1.
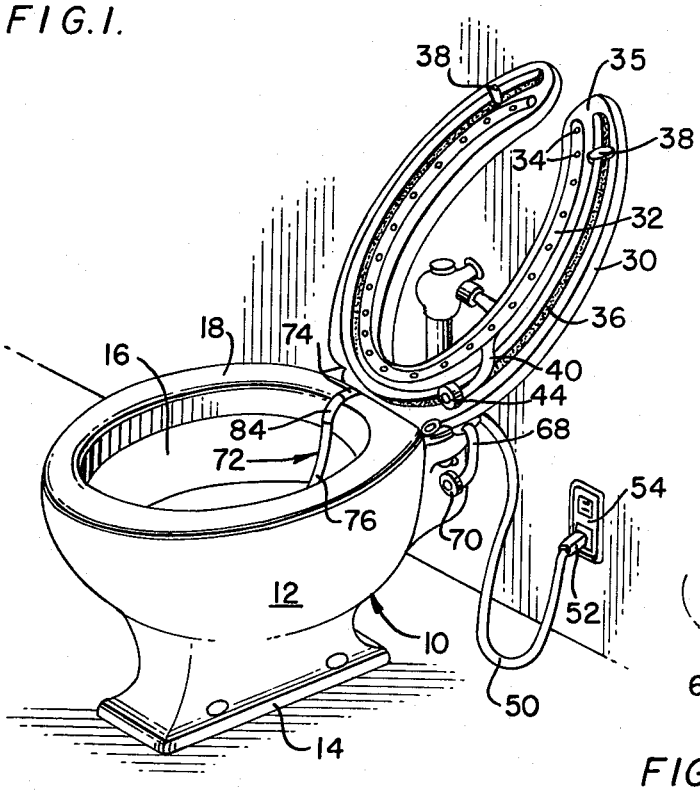
FIG. 8.
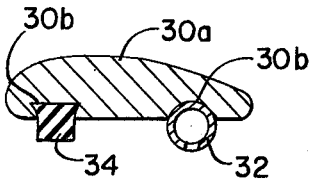
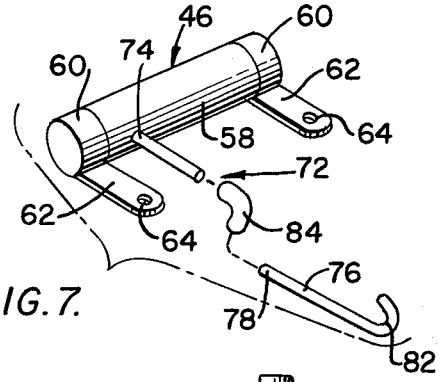
FIG. 7.
FIG. 2.
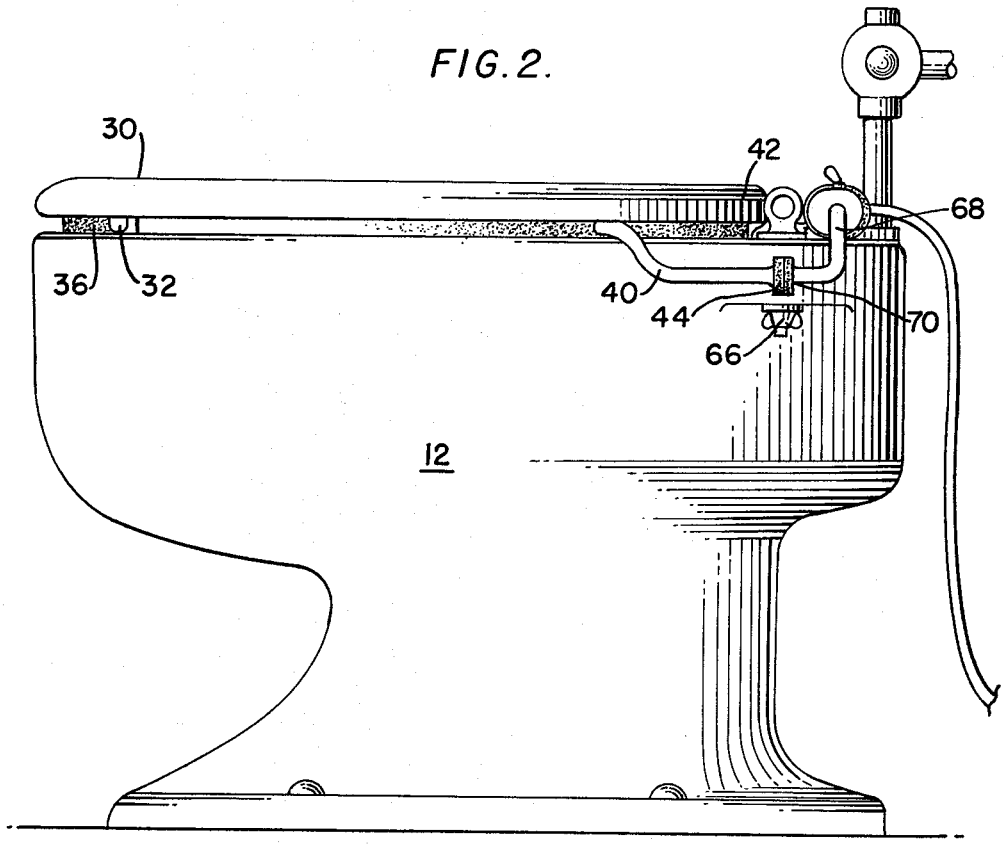

VENTILATED TOILET SEAT

BACKGROUND OF THE INVENTION (1) Field of the Invention

The present invention is directed to new and novel improvements in toilet constructions and specifically to a new and novel arrangement for eliminating offensive odors associated with the normal usage of toilet in the form of a ventilated toilet seat.

(2) Description of the Prior Art

The commercial field, to a slight degree, and the patent art, to a greater degree, are replete with arrangements, systems and devices intended to draw off or expel odorous gases from a toilet. The problem of eliminating such odorous gases, occasioned by normal usage of a toilet, has been recognized but not fully solved because the various and sundry attempted solutions have been too structurally and operationally complicated and involved, expensive and have detracted from the normal appearance of conventional toilets. For these reasons there are very few commercially available and hardly any successful ventilating installations.

The solutions proposed in the prior patent art are of the type involving the installation and usage of additional water flushing mechanisms, such as disclosed in U.S. Pat. No. 3,568,216, or venting assemblies that convey odors to atmospheric venting pipes, such as disclosed in Patents 3,416,167 and 3,703,010.

Such solutions necessitate the structural modification of existing toilets and are consequently expensive to install. And they are also expensive to use. In addition, the necessary modifications detract from the simple normal appearance of a toilet.

One of the least complicated approaches is disclosed in Patent 2,728,921 wherein the bowl is formed with a bore to receive a piping that is connected to a vent pipe leading through the roof of the building to the atmosphere.

However, the venting to the atmosphere is objectionable. And also, the lack of a force factor means that all odors will not be removed or removed fast enough before they can become objectionable. Furthermore, the toilet unit itself must be structurally modified.

And an objection common to each of such patented installations is that they are not adapted for commercial toilets of the type found, for example, in hospitals or nursing homes. The problem existent in such locations is the dual one of patient user of the toilet and nurse or orderly attendant whose function is to assist the patient in the use of the toilet facility. In such commercial installations there is a need for a quick and positive acting odor remover arrangement which can be easily installed without necessitating structural modification of the conventional toilet which does not have the flush tank usually found in household toilet assemblies. In such commercial type assembly there is only a simple bowl with a horse shoe type seat as opposed to the closed ring seat found in a household unit.

SUMMARY OF THE INVENTION

Recognizing the deficiencies of the prior art, a primary object of the present invention is to provide a positive and fast acting suction type odor remover installation for any type of toilet and which can be installed and operated quickly, easily and inexpensively without necessitating structural modifications of the toilet.

A further important object of the present invention is to provide a ventilated toilet of the household or commercial type wherein odors are captured, as the toilet is in use, and are conveyed down into and through the normal outlet passage of the toilet into the sewer pipe while sewer gases are prevented from rising up.

A further important object of the present invention is to provide a simple, inexpensive and compact ventilated toilet seat which can replace, as a unit, a conventional seat and which is self-equipped to remove odors from the associated bowl. Such ventilated toilet seat can be easily installed on toilets of any type without requiring structural modification of the toilet and without calling for the expertise of a plumber or the tools of the plumbing trade.

In one aspect, the present invention involves the placement, as by utilizing a simple epoxy or other suitable adhesive, of a perforated suction tube on the underside of a toilet seat in a position so that the perforations or holes in such tube face inwardly toward and communicate with the inside of the toilet bowl. In addition to such suction tube, which first captures the odors from the bowl, a sealing gasket is fixed, as by adhesive, to the underside of the seat outwardly of the suction tube so as to block the passage of odors from beneath the seat and ensure the positive entry of all odors into the suction tube. The suction tube has an extension that projects outwardly and rearwardly of the seat at the inner hinged end thereof.

It is also proposed to make the suction tube and gasket integral with the seat and formed on the underside thereof during the fabrication of the seat.

An electrically powered suction blower unit is positioned at the rear end of the seat so as to rest on the rear ledge or lip of the bowl. The suction blower unit is provided with straps or brackets that encircle and hold or otherwise are structurally associated with and project from it. Such straps or brackets have projecting end portions that have openings to receive the conventional bolts which attach a seat to a bowl. The suction blower unit is thus mounted as a part of the seat onto the bowl. Such unit is provided with an electrical conductor cord that can be connected to a conventional 110 volt convenience outlet. Thus, normal household current will power the electrical motor of the suction blower unit through a switch means that can be manually activated or can be a pressure reactive type switch mounted on the underside of the toilet seat and adapted to be turned on when the seat is down and pressure is placed thereon.

The extension of the suction tube terminates at its outer free end in a disc-like fitting and the suction blower unit has an inlet tube that has an outer free end terminating in a disc-like fitting. Such fittings have flat outer faces that are adapted to be brought into positive and air tight contact when the seat is in a down position. This supplies a simple mating face joint between the suction tube and the suction blower unit whereby the seat can be raised and lowered without regard to the odor removing installation.

The suction blower unit has an outlet or discharge tube that extends into the bowl at the back thereof and which has an outer end portion that is inserted behind the normal trap in the bottom of the bowl at the entrance opening to a drain passage which is connected to the stand pipe leading to a conventional sewer line. The outer end portion is immersed within the water normally maintained within the bottom of the bowl and positioned behind the trap but at a level above the entrance opening so that sewer odors and gases cannot enter the same to escape from the sewer into the bowl.

The discharge tube is formed in sections with an upper section being a part of the blower suction unit and extending radially therefrom so as to overlie the upper edge of the bowl. The discharge tube has a lower section that can be cut in the field to fit any toilet. It constitutes the vertical portion of the tube and terminates at its lower end in a hook that fits under the trap and defines the outer discharge end portion of the discharge tube. The upper and lower sections are joined together in the field by means of a plastic cement elbow.

BRIEF DESCRIPTION OF THE DRAWINGS

FIG. 1 is a perspective view of a toilet equipped with a ventilated toilet seat and ventilating assembly in accordance with the present invention.

FIG. 2 is a side elevational view of the toilet of FIG. 1.

FIG. 7 is an exploded perspective view of the discharge tube from the blower suction unit.

FIG. 8 is a cross-sectional showing of a modified form wherein the suction tube and sealing gasket are formed integral with the underside of the seat during fabrication of the seat.

DESCRIPTION OF THE PREFERRED EMBODIMENTS

Figure 3:
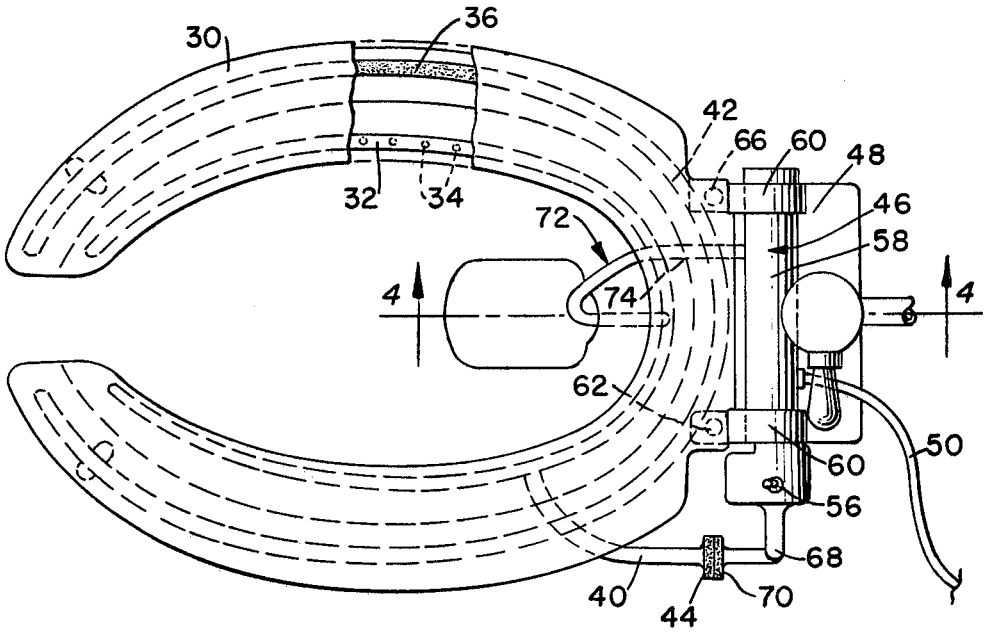
FIG. 3 is a top plan view of such toilet.

With continued but more specific reference to the drawings, and, initially to FIGS. 1–7, the reference numeral 10 generally designates a conventional toilet that includes the usual bowl 12 having a base 14 adapted to be fastened to the floor. The bowl further has an interior 16 and an upper edge or rim 18 in the form of a water channel having water inlets 20 opening into the upper end of the interior 16 of the bowl. The base of the bowl, interior-wise, is shaped to provide a drain or discharge passage 22 in communication with a stand pipe 24 leading to a sewer line (not shown). Above the discharge passage 22 an outlet trap 26 is provided and normally the bottom of the bowl contains a dormant water pool 28.

The toilet 10 is shown as being of the commercial type, such as found in commercial establishments like hospitals, nursing homes and the like, in that it has no flush tank associated therewith and the seat 30 is of the horse shoe or U-shaped type. This is in differentiation from the oval or ring type seat found in homes and the usual flush tank. The toilet 10 is serviced by valved pipe connection to a main pipe for the supply of flush water.

Of course, the type or nature of the toilet and the seat associated therewith has no direct bearing on the odor venting system of the present invention. But, the commercial type has been used for disclosure purposes because it is the most difficult and yet the most important type to be ventilated.

Also, the outlet trap 26, which is shown as being disposed at the rear end of the bowl, could be positioned at the front end thereof.

The present invention includes a suction tube 32 formed of pliable material, like plastics, rubber or the like, and containing a number of apertures or perforations 34. The tube 32 is affixed to the underside 35 of the seat 30 in a manner, as shown best in FIG. 5, so that the tube is inwardly of the bowl edge 18 when the seat is in a down position and so that, consequently, the openings 34 are in communication with the interior 16 of the bowl. Such affixation can be effected in various ways. One manner is to fasten the tube to the underside of the seat by adhesive means.

In the instance of the shown seat 30, the suction tube 32 is of a generally U-shaped design. But given a closed ring type seat, the tube would extend all around the underside thereof. In any event, the suction tube 32 is placed on the underside of the seat in a way so as to be inwardly of the upper edge 18 of the bowl when the seat is down and so that the openings 34 face the inside 16 of the bowl. Thus, the openings in the tube 34 are in free communication with the interior of the bowl when the seat is resting on the upper edge 18 of the bowl.

Figure 5:
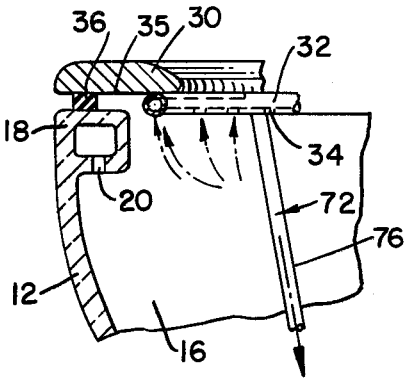
FIG. 5 is a detailed vertical sectional view taken substantially on line 5—5 of FIG. 4.
Figure 6:
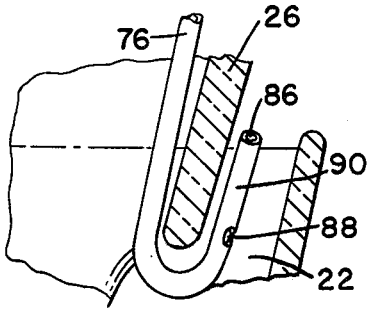
FIG. 6 is a fragmentary view showing the relation of the outer end portion of the discharge tube with the trap in the toilet bowl.

In order to ensure that odors emanating from the interior 16 of the bowl 12 must pass through the openings 34 into the suction tube 32 without seaping between the seat 30 and the bowl rim 18 to escape from the bowl, the underside of the seat is provided with a sealing gasket 36. Such sealing element is in the form of a strip of plastic or rubber that is secured by adhesive or other means to the underside of the seat radially outwardly of the suction tube 32 and in a placement so as to rest on the bowl edge 18, as shown in FIG. 5. The sealing gasket 36 is of a thickness commensurate with that of the conventional bumpers 38 provided on the underside of the seat 30 adjacent the open front thereof.

The suction tube 32 is provided with an outlet extension 40 that projects outwardly and rearwardly from the closed inner hinged end 42 of the seat 30 and is so arranged as to be out of the way of normal usage of the seat, as shown in FIG. 3. And also it is positioned so as not to interfere with the raising and lowering of the seat. The extension 40 terminates at its outer end in a flat disc-like fitting 44 which is of suitable adherent material, like rubber or plastic, and which has a center opening coinciding with the inner diameter of the tubular extension 40.

A suction blower unit 46 which has an electric motor is mounted on the rear lip 48 of the bowl 12 and is equipped with a cord 50 that has a plug 52 for insertion in a conventional convenience outlet 54 of 110 volt house wiring. The unit 48 is provided with a manual on-off switch 56. However, a pressure reactive automatic switch can be affixed to the underside of the seat 30 and connected to the unit 46 so as to activate it when the seat is down and the pressure of a person sitting thereon is exerted thereon.

As particularly shown in FIGS. 3 and 7, the suction blower unit 46 includes a housing 58 which is adapted to be arranged laterally of the rear ledge or lip 48 of the bowl and to rest thereon. The housing 58 is provided with encircling straps 60 that have flat projecting end portions or brackets 62. Such end portions are formed with apertures 64 and are formed so that they project forwardly of the suction blower unit. The apertures 64 are formed to receive the shanks of the bolt units 66 that fasten the seat 30 to the bowl in the conventional manner.

Thus, the suction blower unit 46 is mounted on the bowl 12 by the same bolt means 66 hat attaches the seat 30 in a normal way on the bowl.

The suction blower unit 46 has at one end an inlet tube 68 which terminates at its outer free end in a flat disc-like fitting 70 that is similar to the fitting 44 and with which it is adapted to facially mate in an air tight fashion when the seat is down, as shown in FIG. 3. The flat disc-like fittings 44 and 70 provide a simple but effective means of permitting the seat 30 to be raised or lowered about its hinged end 42 without offering any interference to the connection between the suction tube 32 and the suction blower unit 46. When the seat is down the connection between the suction tube 32 and the suction blower unit 46 will be effected through the facial mating of the fittings 44 and 70, as shown in FIG. 3. The fittings engage tightly together in their facial contact and are of such material, as plastic or rubber, so as to afford an air tight seal in their facial engagement.

The suction blower unit 46 has a discharge tube 72 which is constituted by an upper or horizontal portion 74 and a lower or vertical portion 76. The horizontal upper portion 74 is formed integral with the housing 58 for the suction blower unit 46 and is in communication with the discharging interior thereof. The upper portion 74 projects laterally straight out from the suction blower unit in a manner to overlie the rear end portion of the upper edge 18 of the bowl. The upper portion is of a diameter less than the sealing gasket 36 or the bumpers 38 so that it is not engaged by the seat when the seat is in a down position.

The lower vertical portion 76 of the discharge tube is formed from suitable plastics or rubber and has an upper end 78 and a lower upwardly curved or reverted end 82. The lower portion is adapted to have its upper end 78 cut in the field so that the lower portion in of the proper length. In this respect, the uper end 78 is connected to the outer end of the upper horizontal portion 74 by a plastic cement elbow 84 while the curved end 82 is hooked under the trap 26.

Since toilet bowls differ in depth, the straight vertical lower portion can be fitted in the field and have its upper end cut to join it with the upper portion 74 by the juncture elbow 84 in a way so as to ensure proper positioning of the reverted end 82 under the trap 26.

Figure 4:
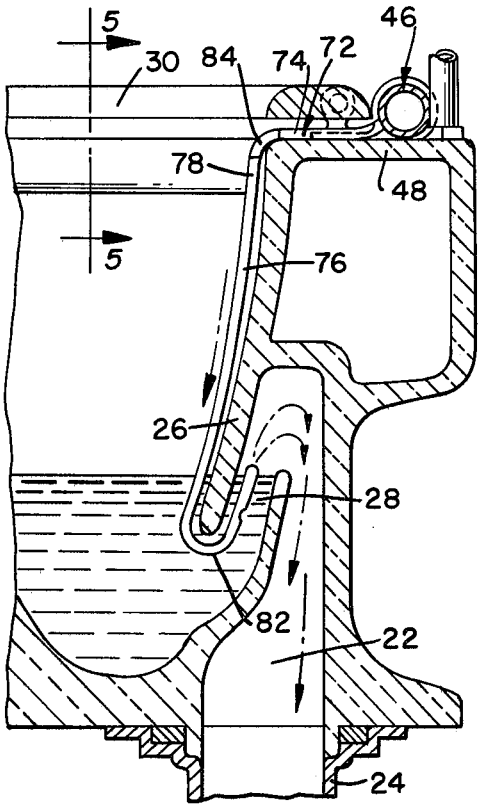
FIG. 4 is a vertical sectional view taken substantially on line 4—4 of FIG. 3.

The reverted outlet end 82 of the lower vertical portion of the discharge tube 72 has an open end 86 through which the odors pass into the discharge passage 22 of the toilet bowl, as shown by the arrows in FIG. 4. A hole 88 is formed in the wall of the free leg 90 of the U-shaped or curved end 82. The hole 88 is provided so as to render indifferent whether the open end 86 is above the water level of the pool 28 in the bowl. Due to the hole 88 and/or the placement of the open end 86 above the water pool, a positive water seal is provided so that sewer gases cannot escape from the discharge passage 22 of the bowl 12 up through the discharge tube 72 to gain access to the ventilated seat and leak from there into the room enclosing the toilet bowl.

In use, the seat is in a lowered position to accommodate a user of the toilet and the fittings 44 and 70 are in sealed engagement. The blower suction unit 46 is then activated by closing the switch means for the electric motor of such unit. This is done manually or automatically in response to the weight of a body sitting on the seat.

All odors from the bowl 12 are then drawn into the suction tube 32 and passed by the blower suction unit 46 into the discharge tube 72 and from there into the discharge passage 22 of the bowl and then into the sewer line. The unit 46 is powerful enough to force the odors through the open end 86 of such tube even in the event it might be below the level of the water pool 28 and, of course, through the sealed end 82 that remains sealed off from sewer gases by the water seal in acting on the hole 88 in the end.

It is intended that the invention can take at least two commercial forms. In the one instance, it can be made and sold as a ventilating kit to be installed in an existing toilet and on an existing seat without structural modification of either. All that will be required will be to remove the seat bolts 66 and then place the suction blower unit on the rear ledge 48 of the bowl so that the apertures 64 in the strap ends 62 are aligned with the vertical holes in the bowl ledge. The suction tube 32 and sealing gasket 36 will then be secured by adhesive onto the underside of the seat. Whereupon the seat and the strap ends 62 will be attached to the bowl by the bolts 66. Then the vertical portion 76 of the discharge tube will be placed in the bowl so that the curved lower end 82 is hooked under the trap 26. If necessary the upper end 78 can be cut so that the vertical portion is of the proper length. Then the upper end is attached by the elbow 84 to the horizontal portion 74 of the discharge tube.

In another instance, the invention will take the form of a new seat which has the suction tube 32 and the sealing gasket 36 as a part thereof and which includes the suction blower unit. Then, installation will only require removal of an old seat and placement of the new seat with the suction blower unit. Again the vertical portion 76 will be separate from the horizontal portion 74 of the discharge tube so that it can be cut to fit if necessary before it is joined to the horizontal portion by the elbow 84.

One form of such seat assembly is shown in FIG. 8 wherein the underside of the seat **30*a* is provided with appropriate grooves 30*b* to receive and house the suction tube 32 and the sealing gasket 34** inserted in such grooves during fabrication of the seat.

Of course, while the preferred embodiments of the present invention have been shown in the drawings and described herein, such are merely exemplary of the invention which is defined and only delimited by the spirit and terms of the appended claims.

What is claimed is:

1. For use with a toilet having a bowl provided with a base formed internally with a discharge passage to be connected to a piping for communication with a sewer line and provided with a trap above said passage and with an upper rim portion on which a seat that is hinged to the bowl is adapted to rest with a normal pool of water being in the bowl above the trap so as to provide a water seal to prevent any gases from entering into the bowl from the sewer line; a ventilating arrangement for removing odors from the bowl comprising a suction line communicated with the interior of the bowl when the seat is rested on the rim portion, a power driven suction blower unit mounted adjacent the bowl and having an inlet end connected to the suction line and having an outlet and an exhaust tube connected to said outlet and having a portion positioned vertically within the bowl with said vertical portion having an elbow positioned within the bowl trap and provided with a free terminal outlet portion positioned behind the trap and having opening means disposed in arrangement with the pool of water so as to form a trap in the exhaust tube whereby odors from the bowl are conveyed directly to the discharge passage of the bowl for passage to the sewer line while the normal water pool in the bowl provides a water seal to prevent any sewer gases from entering the exhaust tube through the elbow.

2. The invention of claim 1 wherein said suction line is a tube provided with a plurality of apertures and fastened to the underside of the seat in a position so that it lies within the rim portion of the bowl in communication with the interior of the bowl when the seat is rested on the rim portion and including a sealing gasket affixed to the underside of the seat radially outwardly of said tube and adapted to engage with the rim portion of the bowl.

3. The invention of claim 1 wherein said suction line is attached to the underside of the seat and has an outlet end extending laterally under the seat and projecting therefrom and terminating in an outer end and the inlet end of said suction blower unit has an outer end, said outer ends being provided with disc-like fittingsthat engage facilly in an air tight coupling when the seat is rested on the rim portion of the bowl.

4. The invention of claim 3 wherein said bowl has a rear lip portion and said suction blower unit is seated thereon with the inlet end extending therefrom laterally of the lip portion and having an outer elbow terminating in the outer end with the fitting and said outlet end of the suction line extends rearwardly from one side of the bowl when the seat is rested on the rim portion so as to be in axial alignment with the elbow whereby the fittings can mate in facial engagement when the seat is rested on the rim portion.

5. The invention of claim 1 wherein said discharge tube of the suction blower unit has a horizontal portion adapted to seat on the rim portion and an elbow positioned vertically inwardly of the rim portion and said vertical portion of the discharge tube has an upper end fixedly attached to the elbow.

6. The invention of claim 1, wherein the free terminal outlet portion of the elbow has an open end that constitutes the opening means.

7. The invention of claim 6, wherein the free terminal outlet portion is provided in its wall inwardly of the open end with a hole that also constitutes the opening means and renders indifferent whether the open end is above the water seal in the pool of water in the bowl.

* * * * *